United States Patent [19]

Marshall

[11] Patent Number: 4,470,162

[45] Date of Patent: Sep. 11, 1984

[54] CLOSET FLANGE ASSEMBLY

[75] Inventor: Marshall W. Marshall, Tyler, Tex.

[73] Assignee: Wade Incorporated of Tyler Pipe, North Swan, Tex.

[21] Appl. No.: 502,767

[22] Filed: Jun. 9, 1983

[51] Int. Cl.[3] ..... E03D 11/00

[52] U.S. Cl. ..... 4/252 R; 285/56; 285/59

[58] Field of Search ..... 4/252 R, 191; 285/3, 285/4, 56, 57, 58, 59, 60

[56] References Cited

U.S. PATENT DOCUMENTS

| | | | |
|---|---|---|---|
| 3,012,252 | 12/1961 | Graddy | 4/252 R |
| 3,185,500 | 5/1965 | Luther | 285/4 |
| 3,501,172 | 3/1970 | Pickard | 285/59 |
| 3,952,340 | 4/1976 | Cuschera | 4/252 R |
| 4,059,289 | 11/1977 | Morris et al. | 285/56 |
| 4,090,267 | 5/1978 | Cuschera | 4/252 R |

*Primary Examiner*—Henry K. Artis

*Attorney, Agent, or Firm*—Herbert E. Haynes, Jr.

[57] ABSTRACT

A closet flange assembly for anchoring a water closet to a floor and sealingly connecting the water closet to a waste drain conduit. The closet flange assembly includes a drain body having a flange for attachment to the floor and to the water closet and having a compression gasket circumferentially compressingly contained and held against axial movement within the axial bore provided in the drain body. The compression gasket has an axial bore which provides an interference fit with the periphery of the waste drain conduit when the drain body and compression gasket are axially slidingly pushed onto the waste drain conduit.

9 Claims, 4 Drawing Figures

CLOSET FLANGE ASSEMBLY

BACKGROUND OF THE INVENTION

1. Field of the Invention

This invention relates generally to devices for connecting plumbing fixtures to waste drain conduits, and more particularly to the combination of an especially configured flanged drain body and sealing gasket which mounts a water closet on a supporting floor surface and sealingly interconnects the water closet and a waste drain conduit.

2. Brief Description of the Prior Art

Traditionally, water closets are attached to the supporting floor and sealingly connected to a waste drain conduit by means of a body which is mechanically connected to both the water closet and the floor by means of suitable fasteners with the sealed interconnection being made by a lead and oakum joint. As is well known in the art, making up a lead and oakum joint is a time consuming operation and requires a relatively high degree of skill on the part of the installer.

Due to the skill and time factors involved in making up lead and oakum joints, several alternative devices have been proposed in efforts to reduce costs and simplify the installations. The alternative devices include what is commonly referred to as a "mechanical joint" for forming the sealed interconnection of the water closet and the waste drain conduit. Generally, these alternative prior art devices include a flanged drain body, compression gasket, and some sort of mechanical device for exerting compressive forces on the gasket for seal forming purposes.

Examples of this alternative type of device, which are the most relevant prior art known to the Applicant, are shown in U.S. Pat. Nos.: 3,579,670; 3,896,511; 3,952,340; and 4,090,267.

In prior art U.S. Pat. No. 3,579,670, a sealing gasket and compression ring are located below and externally of the flanged drain body, all of which are in circumscribing relationship with the waste drain conduit. A plurality of screws extend downwardly from the flanged drain body to the compression ring and are used to move the compression ring axially toward the flanged drain body to axially exert compressive forces on the gasket which is interposed therebetween to cause radial expansion, or swelling, of the gasket into sealed engagement with the conduit and the flanged drain body. The downwardly extending plurality of screws must be brought into threaded engagement with aligned bores formed in the compression ring with this being a blind operation and thus not particularly easy to accomplish.

In U.S. Pat. No. 3,896,511, the sealing gasket is disposed within the bore of the flanged drain body so as to be in circumscribing relationship with the waste drain conduit. An externally threaded compression ring is threadingly mounted in the bore of the flanged drain body and is moved axially downwardly to axially exert compressive forces which radially swells the gasket. As in all large diameter threaded devices, achieving a proper threaded engagement between the ring and the flanged drain body is not always easily accomplished and a special tool, such as a spanner wrench, is needed to achieve the desired and often needed amount of compression force. A particular problem with this type of device is that after it has been installed for any length of time, corrosion, contamination, and the like, will make it particularly difficult, if not impossible, to disassemble should it become necessary to repair or replace the closet flange or reset the water closet.

U.S. Pat. No. 3,952,340, is a device similar to that described above in regard to U.S. Pat. No. 3,896,511, with the exception that a snap ring is used in place of the externally threaded compression ring to exert axially applied compressive forces to radially swell and hold the gasket in place. The compressive forces exerted by the snap ring is not adjustable in that it is limited by the physical placement of the snap ring groove in which the snap ring is mounted. Additionally, should the need arise to remove the snap ring, such removal can be difficult.

U.S. Pat. No. 4,090,267, provides another similar closet flange device which includes a flanged body with a compression gasket within the bore thereof and a flanged compression ring which is axially movable in the bore of the flanged drain body. The compression ring is moved downwardly into compressing engagement with the gasket by means of plural screws which interconnect the flanges of the body and the compression ring. As with any device which relies on circumferentially spaced multiple fasteners to exert an axially applied force, in this prior art device it can be very difficult to achieve equal circumferentially applied compressive forces on the gasket. And, as mentioned above, subsequent removal of threaded fasteners used in a hostile environment, such as is the case in closet flange applications, can prove difficult and sometimes impossible.

The above described mechanical joint closet flange devices while providing some installation labor saving advantages over the traditional closet flange which employs the lead and oakum joint sealing arrangement, they are not without problems as described above. And, generally, they are more expensive from an initial cost standpoint due to their being three component assemblies, i.e., flanged drain body, compression gasket and compression ring. Further, these prior art mechanical joint closet flanges require more than an ideal amount of installation time and skill.

Therefore, a need exists for a new and improved closet flange which overcomes some of the problems and shortcomings of the prior art.

SUMMARY OF THE INVENTION

In accordance with the present invention, a new and improved closet flange assembly is disclosed for attaching a water closet to a supporting floor and forming leak-proof interconnection between the water closet and a waste drain conduit which extends at least part way through a hole formed in the floor for that purpose.

The closet flange assembly of the present invention includes a flanged drain body and compression gasket which are especially configured to cooperate with the waste drain conduit to circumferentially apply compressive forces on the gasket as opposed to the axially applied compression forces of the prior art. In this manner, the closet flange assembly of the present invention will be seen to be a two component assembly in that it does not require the use of any of the devices or components for applying axially compressive forces on the sealing gasket.

The flanged drain body is of generally cylindrical configuration with an endless flange extending integrally and radially from the upper end thereof. The flange is provided with a first array of apertures through which suitable fasteners are passed to attach the flanged body to the floor in a position where the cylindrical body portion thereof depends through the hole provided in the floor. A second array of apertures is provided in the flange for retaining other fasteners which extend upwardly therefrom for mounting of the water closet. The flanged drain body is provided with an especially configured bore which passes axially therethrough. The bore is formed at its upper flanged end with a diameter which is somewhat larger than the outside diameter of the waste drain conduit to which the flanged drain body is to be attached so that the conduit will pass axially and freely through the upper bore portion. The lower bore portion of the flanged drain body is of increased diameter, i.e., it is counterbored, for receiving the resilient compression gasket which is inserted axially therein from the lower non-flanged end of the flanged drain body. The counterbore is provided with a diameter which provides an interference fit with the compression gasket and has an annular groove formed proximate the bottom open end of the counterbore.

The compression gasket is formed of a resilient elastomeric material such as Neoprene and has a sleeve-like body of generally cylindrical configuration which defines an axial bore therethrough. An endless flange, or rim, extends radially from the lower end of the gasket body and an annular bead is provided about the periphery of the gasket body adjacent and axially spaced from the flange. When the compression gasket is mounted in the counterbore of the flanged drain body, the annular bead of the gasket is disposed within the annular groove of the counterbore, and the endless rim of the gasket is in abutting engagement with the ring-shaped lower end of the depending cylindrical body portion of the flanged drain body. In addition to the interference fit of the gasket in the axial bore, the annular bead and the endless rim of the gasket interact respectively with the annular groove and the ring-shaped lower end of the flanged drain body to prevent axial displacement of the compression gasket.

The compression gasket is provided with an endless annular deflectable flap which extends angularly and upwardly from proximate the inner edge of the lower end of the gasket into the bore thereof. Similarly, the upper end of the gasket is provided with an endless annular deflectable ridge which extends angularly upwardly and inwardly into the bore of the gasket.

When the flanged drain body having the compression gasket installed therein, is pushed axially downwardly onto the waste drain conduit, the deflectable flap and the deflectable ridge of the gasket form an interference fit with the waste drain conduit with the result being that the flap and ridge are deflected outwardly with this outward deflection being resisted by the confining of the gasket within the counterbore of the flanged drain body. Therefore, circumferentially applied forces are applied outwardly on the gasket body by the waste drain conduit and circumferentially compressive forces are exerted inwardly on the periphery of the compression gasket by the flanged drain body, to form a leak-proof sealed connection between the flanged drain body and the waste drain conduit.

Accordingly, it is an object of the present invention to provide a new and improved closet flange assembly for attaching a water closet to a floor and making a leak-proof connection between the water closet and a waste drain conduit.

Another object of the present invention is to provide a new and improved closet flange assembly which is simple to install and highly reliable.

Another object of the present invention is to provide a new and improved closet flange assembly which is a two component assembly comprising in combination, a flanged drain body and a resilient compression gasket.

Another object of the present invention is to provide a closet flange assembly of the above described character wherein circumferentially compressive forces are applied to the resilient compression gasket to form the leak-proof sealed interconnection between the flanged drain body and the waste drain conduit.

Another object of the present invention is to provide a closet flange assembly of the above described type wherein the flanged drain body is provided with an axial bore for constrainingly receiving the resilient compression gasket and preventing axial displacement thereof.

Another object of the present invention is to provide a closet flange assembly of the above described character wherein the flanged drain body is provided with an annular groove in the axial bore thereof with the bore being sized to provide an interference fit with the resilient compression gasket which is axially mounted therein.

Still another object of the present invention is to provide a closet flange assembly of the above described type wherein the resilient compression gasket has a sleeve-like cylindrical body with an annular bead which is disposed in the annular groove of the flanged drain body and has a radially extending rim which is in abutting engagement with the ring-shaped end which circumscribes the axial bore of the flanged drain body.

Yet another object of the present invention is to provide a closet flange assembly of the above described character wherein the bore of the resilient compression gasket forms an interference fit with the periphery of the waste drain conduit so that the gasket is circumferentially compressed by interaction of the waste drain conduit and the flanged drain body.

The foregoing and other objects of the present invention, as well as the invention itself, may be more fully understood from the following description when read in conjunction with the accompanying drawings.

DESCRIPTION OF THE PREFERRED EMBODIMENT

Figure 1:
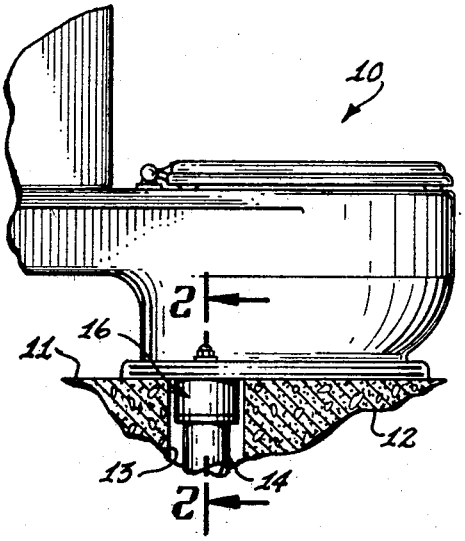
FIG. 1 is a fragmentary side elevational view of a typical water closet installation which is partially in section to show the water closet being attached to a floor and sealingly interconnected to a waste drain conduit by the closet flange assembly of the present invention.

Referring more particularly to the drawings, FIG. 1 shows a fragmentary side elevational view of a typical water closet installation wherein a water closet 10 is shown as being attached to the surface 11 of a floor 12. The floor 12 is provided with a hole 13 through which a waste drain conduit 14 extends upwardly for connection to the water closet 10. The attachment of the water closet 10 to the floor 12 and the interconnection of the waste drain conduit 14 to the water closet is accomplished by the closet flange assembly of the present invention which is indicated in its entirety by the reference numeral 16.

Figure 3:
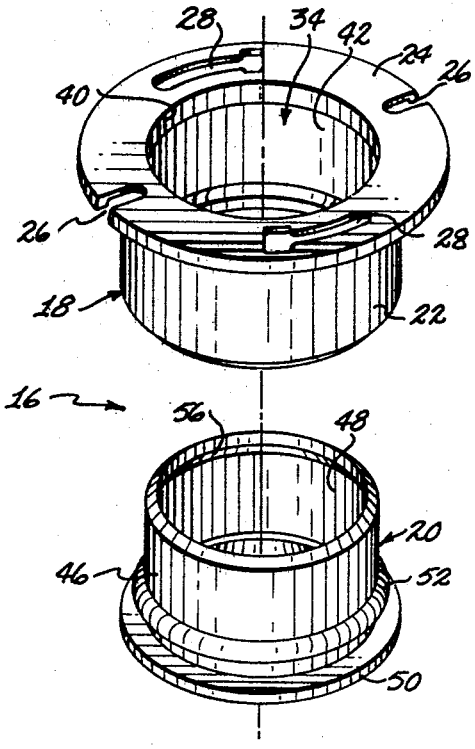
FIG. 3 is an exploded perspective view of the flanged drain body and compression gasket which are the two components of the closet flange assembly of the present invention.
Figure 4:
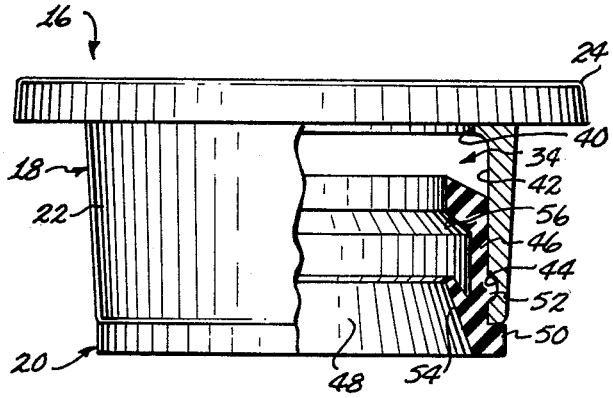
FIG. 4 is a side elevational view of the closet flange assembly which is partially broken away to show the various features and positional relationship of the flanged drain body with the compression gasket installed therein prior to the installation of the closet flange assembly on the waste drain conduit.

As best seen in FIGS. 3 and 4, the closet flange assembly 16 includes a flanged drain body 18 having a resilient compression gasket 20 installed therein as will hereinafter be described in detail.

The drain body 18 includes a substantially cylindrical body portion 22 with an integral endless flange 24 extending radially from the uppermost end of the body 22. The flange 24 is provided with a first aperture means in the illustrated form of a diametrically opposed pair of radial slots 26 and a second aperture means in the illustrated form of a pair of diametrically opposed arcuately configured key-hole shaped apertures 28. These slots 26 and apertures 28 are for use in anchoring the closet flange assembly 16 to the floor 12, such as by means of screws (not shown) in the case of wooden floors, anchor bolts (not shown) in the case of concrete floors, and for attaching the water closet 10 to the anchored closet flange assembly, such as by means of the T-bolts 30 shown best in FIG. 2. It should be noted that the slots 26 and apertures 28 can be selectively used to accomplish the two different anchoring and attaching functions as required by the particular installation. In the illustrated example, the T-bolts 30 are shown as being mounted in the radial slots 26 and extending upwardly therefrom for attachment of the water closet to the flanged drain body. The apertures 28 are of arcuate key-hole shaped configuration to allow rotational positioning of the closet flange assembly 16 into a position where the water closet 10 can be attached thereto in the proper aligned relationship with respect to building walls, and the like.

When mounting the water closet 10 on the water closet flange assembly 16, a suitable compressible gasket 32 is interposed between the upwardly facing surface of the flange 24 and the downwardly facing surface of the water closet to achieve a tight leakproof seal therebetween.

Figure 2:
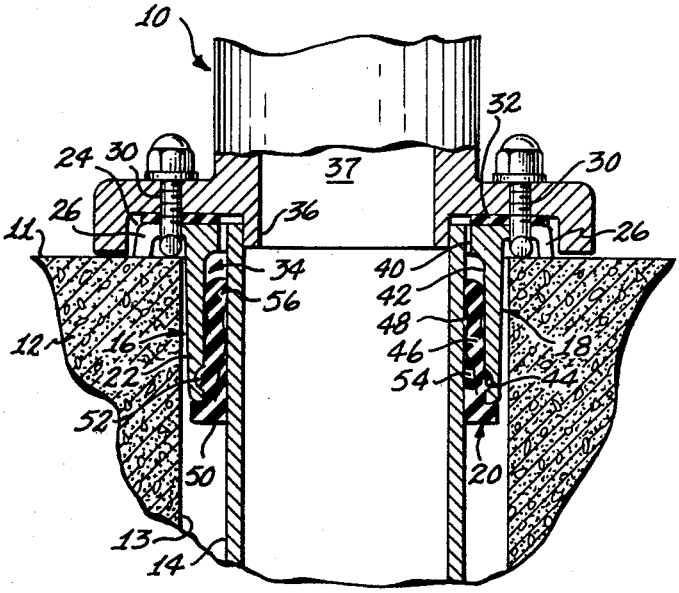
FIG. 2 is an enlarged fragmentary sectional view taken along the line 2—2 of FIG. 1.

The drain body 18 includes a substantially cylindrical body portion 22, as hereinbefore mentioned, and an especially configured axial bore 34 is formed therethrough. When the drain body 18 is anchored to the floor 12 as described above, the body portion 22 extends susbstantially coaxially through, or at least into, the hole 13 provided in the floor with the waste drain conduit 14 extending coaxially upwardly in the bore 34 of the drain body 18. As shown in FIG. 2, the water closet 10 is provided with a depending lip 36 which circumscribes the lower end of the waste passage 37 provided in the water closet. When the water closet 10 is anchored to the water closet flange assembly 16, the depending lip 36 extends axially into the bore of the waste drain conduit 14 as shown.

The flanged drain body 18 is configured to provide the axial bore thereof with an upper bore portion 40 through which the waste drain conduit 14 is freely axially passed, and a diametrically enlarged bore portion 42, or counterbore, which is formed in the mouth, or lower end, of the bore 34. The flanged drain body 18 is further configured to provide an annular groove 44 which is adjacent the mouth of the bore 34 and opens inwardly into the counterbore 42.

The counterbore 42 is provided to captively contain the compression gasket 20 which is axially inserted therein from the mouth end of the bore 34.

The compression gasket 20 shown in the drawings, and to be described below, is commercially available through recognized plumbing distribution outlets. The gasket 20 is identified as SV Ty-Seal and is manufactured by Tyler Pipe, a subsidiary of the Tyler Corporation, P.0. Box 2027, Tyler, Tex. 75710. In addition, the compression gasket is fully disclosed in U.S. Pat. No. 3,081,102 and 3,573,871.

In view of the commercial availability of the compression gasket 20 and its full disclosure in the above referenced U.S. Patents, the following description thereof will be brief. The gasket 20 is of a resilient elastomeric material with it being preferably formed of Neoprene due to the well known physical characteristics thereof among which are its inherent resistance to the deteriorating chemical actions, such as those resulting from effluents in the waste drain pipe 14, chemicals in the soil, or any other elements which normally are present in the environment of the intended use of the device 16 of the present invention. The gasket 20 is of a sleeve-like configuration having a generally cylindrical sleeve body 46 which defines an axial bore 48. An endless flange or rim 50 extends radially and integrally from the lower end of the sleeve body 46 and an integral endless annular bead 52 is formed about the periphery of the sleeve body in axially spaced proximate relationship to the rim 50. An endless annular deflectable flap 54 extends angularly and upwardly into the bore 48 from proximate the inner edge of the lower end of the sleeve body 46 and similarly, an endless annular deflectable ridge 56 is provided on the opposite end of the sleeve body and which extends angularly into the bore 48 in the same direction as the deflectable flap 54.

The inside diameter of the counterbore 42 of the flanged drain body 18 is sized so as to provide an interference fit with the periphery of the gasket 20 when the gasket is axially inserted therein through the mouth end of the drain body. When installed as shown best in FIG. 4, the rim 50 of the gasket 20 will be in abutting engagement with the ring-shaped end which circumscribes the mouth of the bore 34 of the flanged drain body 18, and the annular bead 52 of the gasket is disposed within the annular groove 44 of the drain body. The annular groove 44 of the drain body 18 and the annular bead 52 along with the rim 50 of the gasket form cooperating elements of a retaining means by which the gasket is held against further axial movement into the bore 34 of the flanged drain body 18. And, the gasket is circumferentially compressed and constrained by the cylindrical body portion 22 of the drain body 18 by virtue of the interference fit therebetween.

When installing the closet flange assembly 16 in the environment hereinbefore described, the drain body 18, having the gasket 20 captively retained in its bore 34, is pushed axially down onto the upstanding end of the waste drain conduit 14. The axial bore 48 of the gasket 20 forms an interference fit with the periphery of the waste drain conduit 14, and the axial movement of the gasket 20 will radially deflect the flap 54 and ridge 56 of the gasket 20 from their normal positions shown in FIG. 4 to their radially deflected positons shown in FIG. 2.

In view of the above, it will be seen that when the closet flange assembly 16 is installed as shown in FIG. 2, the waste drain conduit 14 will circumferentially apply outwardly directed forces on the compression gasket 20 and the flanged drain body will counteractingly apply circumferential forces inwardly on the compression gasket 20. Thus, the resilient compression gasket will be squeezed between the periphery of the waste drain conduit 14 and the counterbore 42 of the flanged drain body 16 and will form a leak-proof seal therebetween.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A closet flange assembly for anchoring a water closet to a floor and sealingly connecting the water closet to a waste drain conduit which extends upwardly in a hole formed through the floor, said closet flange assembly comprising:

(a) a drain body for placement in the hole of the floor and having an axial bore which moves therewith into concentric spaced relationship about the waste drain conduit, said drain body having a radially extending flange at its upper end for attachment to the floor and for anchoring of the water closet thereto;

(b) a resilient compression gasket at the lower end of said drain body and extending axially into the axial bore of said drain body, said resilient gasket movable with said drain body and having a bore for axially sliding onto the periphery of the waste drain conduit when said drain body is placed in the hole of the floor;

(c) cooperative elements of a retaining means on said drain body and on said compression gasket to hold said compression gasket against axial movement in the axial bore of said drain body;

(d) said drain body having its axial bore sized to exert circumferentially compressive forces inwardly on the periphery of said compression gasket; and (e) said compression gasket having means formed in the bore thereof for exerting circumferentially compressive forces outwardly thereon upon axial sliding movement of said compression gasket onto the periphery of the waste drain conduit.

2. A closet flange assembly as claimed in claim 1 wherein the axial bore of said drain body is sized to form an interference fit with the periphery of said resilient compression gasket.

3. A closet flange assembly as claimed in claim 1 wherein said cooperative elements of a retaining means comprise:

(a) said drain body having an annular groove formed therein which opens into the axial bore thereof;

(b) said resilient compression gasket having an annular bead extending from its periphery into said annular groove of said drain body; and (c) said resilient compression gasket having an endless radially extending flange on its lower end which is in abutting engagement with the lower end of said drain body.

4. A closet flange assembly as claimed in claim 3 wherein said annular groove of said drain body and said annular bead of said resilient compression gasket are in upwardly spaced proximate relationships with their respective lower ends.

5. A closet flange assembly as claimed in claim 1 wherein said means formed in the bore of said compression gasket comprises a deflectable annular flap which is deflectingly moved by the waste drain conduit into contiguous bearing engagement with the sidewall which defines the bore of said compression gasket when said drain body is placed in the hole of the floor.

6. A closet flange assembly as claimed in claim 1 wherein said means formed in the bore of said compression gasket comprises a deflectable annular ridge which is deflectingly moved by the waste drain conduit into contiguous bearing engagement with the sidewall which defines the axial bore of said drain body when said drain body is placed in the hole of the floor.

7. A closet flange assembly as claimed in claim 1 wherein said means formed in the bore of said compression gasket comprises:

(a) a deflectable annular flap integral with said resilient compression gasket and extending angularly inwardly and upwardly from the lower end of said compression gasket into the bore thereof; and (b) a deflectable annular ridge integral with said resilient compression gasket at the upper end thereof and extending angularly upwardly into the bore of said resilient compression gasket.

8. A closet flange assembly as claimed in claim 1 wherein said drain body comprises:

(a) a body portion of substantially cylindrical configuration which defines the axial bore of said drain body and having the flange extending radially from the upper end thereof;

(b) said body portion configured to define an upper axial passage bore portion through which the waste drain conduit is freely movable; and (c) said body portion configured to define a lower diametrically enlarged axial bore portion in which said resilient compression gasket is dipsosed.

9. A closet flange assembly as claimed in claim 1 wherein the flange of said drain body is formed with first aperture means for receiving fastener means for attaching said drain body to the floor and second aperture means for receiving fastener means for anchoring the water closet to said drain body.

* * * * *